US012702916B2

(12) United States Patent
Costello et al.

(10) Patent No.: US 12,702,916 B2
(45) Date of Patent: Aug. 11, 2026

(54) PLAYING CARD SECURITY DEVICE

(71) Applicant: LAS VEGAS SANDS CORP., Las Vegas, NV (US)

(72) Inventors: Andrew Costello, Las Vegas, NV (US); Steven Campbell, Las Vegas, NV (US); Ryan Yee, Las Vegas, NV (US)

(73) Assignee: LAS VEGAS SANDS CORP., Las Vegas, NV (US)

( * ) Notice: Subject to any disclaimer, the term of this patent is extended or adjusted under 35 U.S.C. 154(b) by 153 days.

(21) Appl. No.: 18/377,735

(22) Filed: Oct. 6, 2023

(65) Prior Publication Data

US 2025/0114689 A1 Apr. 10, 2025

(51) Int. Cl.
*A63F 1/06* (2006.01)

(52) U.S. Cl.
CPC ..... *A63F 1/062* (2013.01)

(58) Field of Classification Search
CPC ..... A63F 1/062; A63F 2250/58; A63F 1/14; A63F 1/10; A63F 1/16; G09F 3/037; Y10T 292/331
See application file for complete search history.

(56) References Cited

U.S. PATENT DOCUMENTS 4,457,512 A 7/1984 Stevenson
2002/0019256 A1* 2/2002 Bennett ..... G09F 3/02883 463/29
2009/0134575 A1* 5/2009 Dickinson ..... A63F 1/062 273/149 R
2012/0103030 A1* 5/2012 Boesel ..... G09F 3/0317 70/2
2014/0091523 A1* 4/2014 Madding ..... A63F 1/10 273/149 R
2015/0047539 A1* 2/2015 Togiya ..... E05G 1/026 109/75
2019/0241331 A1* 8/2019 Brooks ..... B65D 75/366
2022/0409986 A1 12/2022 Van Genechten et al.
2024/0181330 A1* 6/2024 Van Genechten ..... A63F 1/10

FOREIGN PATENT DOCUMENTS

WO WO 2012/167004 A2 12/2012

OTHER PUBLICATIONS

International Preliminary Report on Patentability for Application No. PCT/US2024/050096, dated May 23, 2025, 5 pages.
International Search Report for Application No. PCT/US2024/050096, mailed Jan. 7, 2025, 12 pages.

* cited by examiner

*Primary Examiner* — Michael D Dennis
(74) *Attorney, Agent, or Firm* — Womble Bond Dickinson (US) LLP

(57) ABSTRACT

A card security device including: a front end; a back end; a lid two lateral sides; an inner space defined by the front end, the back end, the two lateral sides, and the lid; and a card shoe connector at the front end configured to connect to a card shoe wherein the card shoe connector includes an outer portion, an inner portion, and a security seal on the inner portion.

20 Claims, 18 Drawing Sheets

PLAYING CARD SECURITY DEVICE

FIELD

One or more aspects of embodiments of the present disclosure relate to a playing card security device.

BACKGROUND

Gaming locations, such as casinos, store decks of playing cards used for its playing card games (e.g., baccarat, blackjack, casino war, dragon tiger, etc) at secure storage locations. The security of the playing cards is important to prevent tampering of the playing cards and protect the integrity of the playing card games hosted at casinos. When the playing cards are transported from the secure location to the card gaming table, the casinos may take one or more suitable security precautions to prevent tampering of the playing cards while the playing cards are being transported.

However, such security precautions are inherently limiting. For example, the cards may be handled or physically touched by several different personnel while the cards are being transported. The personnel may include the dealer who has to physically touch the playing cards to place them into a card shoe (e.g., a device used by casinos to hold one or more decks of cards use in a card game such as baccarat, blackjack, casino war, dragon tiger, etc.). Each instance of the playing cards being handled by personnel provides an opportunity for playing card tampering, which can affect the integrity of the playing card games. Additional security precautions may be helpful to limit the number of instances that the playing cards are handled by personnel and limit the opportunities for tampering with the playing cards.

SUMMARY

Aspects of embodiments of the present disclosure are directed toward a playing card security device.

According to some example embodiments of the present disclosure, a card security device including: a front end; a back end; a lid; two lateral sides; an inner space defined by the front end, the back end, the two lateral sides, and the lid; and a card shoe connector at the front end configured to connect to a card shoe, wherein the card shoe connector includes an outer portion, an inner portion, and a security seal on the inner portion.

According to some example embodiments, the card shoe connector further includes a latch on the inner portion, the latch being configured to move in a direction parallel to a front end of the card security device from an unconnected position to a connected position.

According to some example embodiments, the security seal is attached above the latch on the inner portion such that it is adapted to break when the latch moves from the unconnected position to the connected position.

According to some example embodiments, the security seal is attached on an upper edge of the latch.

According to some example embodiments, the latch includes a ridge at a bottom edge of the latch.

According to some example embodiments, the ridge has a shape that substantially aligns with a shape of a mechanism on a card security device connector such that the mechanism is permitted to move along the ridge and apply an upward force on the latch.

According to some example embodiments, the latch includes guide openings that are configured to move along metal protrusions when the latch moves from the connected position to the unconnected position.

According to some example embodiments, the security seal includes at least one of a tamper evident tape or a pull-tight seal.

According to some example embodiments of the present disclosure, a card shoe connector on a card security device including: an outer portion; an inner portion; a latch on the inner portion, the latch configured to move in a direction parallel to a front end of the card security device from an unconnected position to a connected position; and a security seal on the inner portion.

According to some example embodiments, the security seal is attached above the latch on the inner portion such that it is adapted to break when the latch moves from the unconnected position to the connected position.

According to some example embodiments, the security seal is attached on an upper edge of the latch.

According to some example embodiments, the latch includes a ridge at a bottom edge of the latch.

According to some example embodiments, the ridge has a shape that substantially aligns with a shape of a mechanism on a card security device connector such that the mechanism is permitted to move along the ridge and apply an upward force on the latch.

According to some example embodiments, the latch includes guide openings that are configured to move along metal protrusions when the latch moves from the connected position to the unconnected position.

According to some example embodiments, the security seal includes at least one of a tamper evident tape or a pull-tight seal.

According to some example embodiments of the present disclosure, a method for breaking a seal on a card security device, the method including: inserting, by a user, a card shoe connector on the card security device into a card security device connector on a card shoe; and breaking, by the user, the security seal via a latch on the card shoe connector that is configured to move in a direction parallel to a front end of the card security device from a connected position to an unconnected position when the card shoe connector is inserted into the card security device connector.

According to some example embodiments, the card shoe connector includes: an outer portion; an inner portion; and a security seal, wherein the latch and the security seal are on the inner portion of the card shoe connector.

According to some example embodiments, the security seal is attached above the latch on the inner portion such that it is adapted to break when the latch moves from the unconnected position to the connected position.

According to some example embodiments, the security seal is attached on an upper edge of the latch.

According to some example embodiments, the security seal includes at least one of a tamper evident tape or a pull-tight seal.

DETAILED DESCRIPTION

Figure 1:
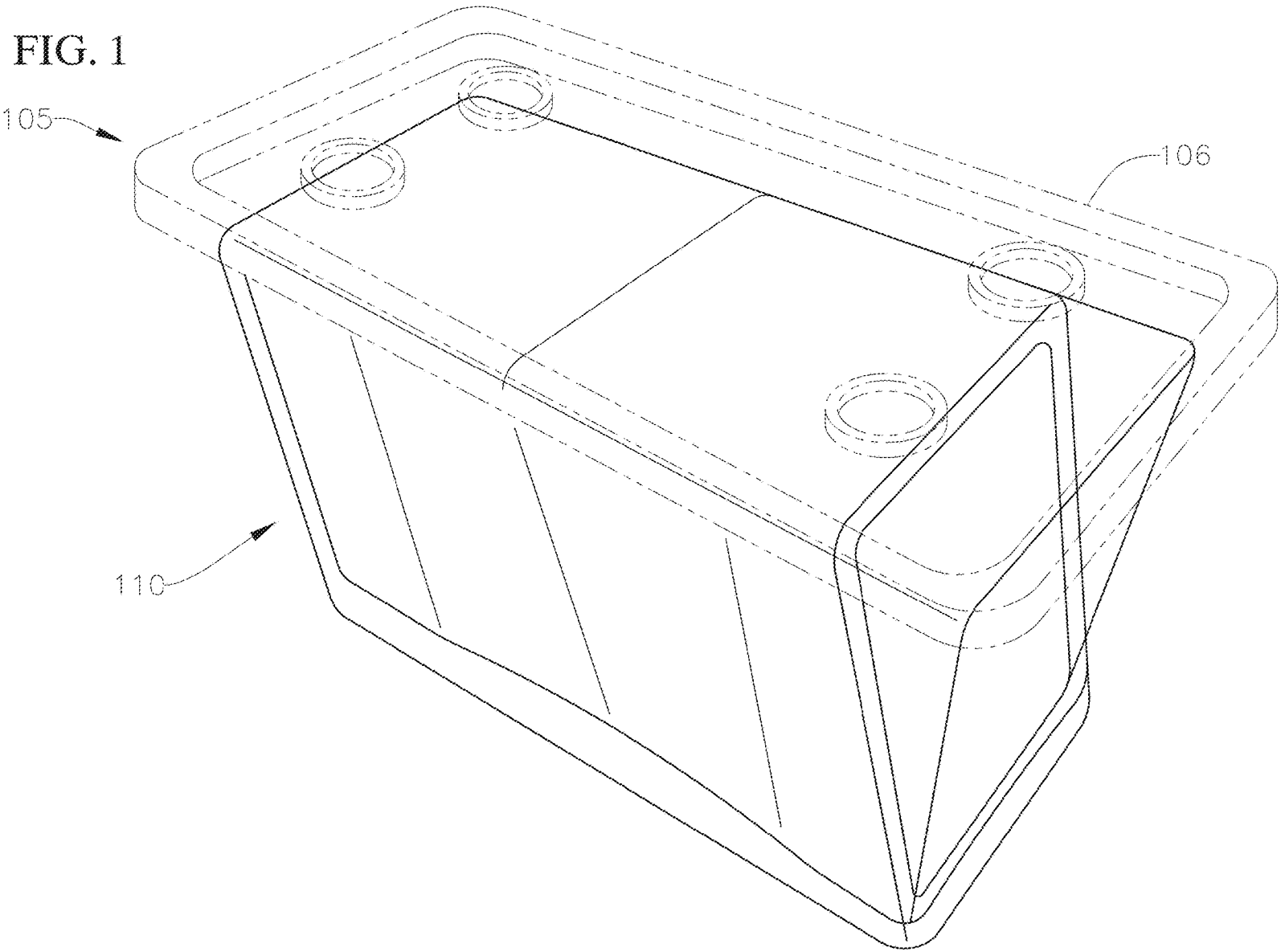
FIG. 1 illustrates a playing card security device.

The exemplary embodiments of the present invention disclosed herein are directed to a playing card security device. According to one or more embodiments of the present disclosure, the playing card security device can be used to transport one or more decks of playing cards from a secure storage site to the card gaming table at a gaming location such as a casino. The security device can limit the number of people who directly handle the playing cards, and limit the number of opportunities for tampering with the playing cards.

In some embodiments, the card security device may be configured to hold (e.g., contain) one or more decks of playing cards. The card security device may include an inner space defined by two lateral sides, a front end, a back end, and a lid (e.g., a removable lid) and the inner space may be capable of holding the one or more decks of playing cards. The playing cards may be loaded and securely sealed in the security device at a secure storage location and can remain sealed inside the security device until the security device is delivered to the card gaming table. The front end of the security device may be configured to be directly inserted into an opening of a card shoe (e.g., a dealing shoe or dealer's shoe) and can be attached to the card shoe without the dealer physically touching the playing cards. The playing cards may then be used for dispensing by the card shoe.

When the playing cards are securely sealed inside the security device, the card security device may be secured with a security seal (e.g., tamper proof seals, tape, locks, etc.) that will be broken if the lid of the security device is removed. As such, the security seal can serve as an indicator that the security device may have been opened, and, thus, indicate that the playing cards may have not been tampered with, during the transporting of the security device. The security seal may be any suitable security seal used in the industry. For example, the security seals may include: tamper evident tape/sticker and pull-tight/"bolt" (e.g., zip tie) seals. If the security seal has been broken during transport, the casino may determine that the playing cards may have been tampered with and prevent the playing cards from being used in a card game.

Additionally, in some embodiments, the card security device may also include a latch that may be configured to move in a direction parallel to a front end of the card security device when the card security device is inserted into the card shoe. Accordingly, the latch of the card security device may be able to break or cut the security seal (e.g., automatically breaks or cuts the security seal) when the card security device is inserted into the card shoe. This latch circumvents the need to have the dealer or other casino personnel to break the seal and physically remove the playing cards from the security device to the card shoe. This latch provides an additional safety precaution that prevents another instance of personnel physically handling the playing cards and protects the integrity of the playing card game.

FIG. 1 illustrates a playing card security device.

As shown in FIG. 1, the security device 105 (e.g., a card vault) may contain one or more decks of playing cards 110. The playing cards 110 may be securely sealed within an inner space of the security device 105. The inner space may be defined by lateral sides, a front end, a back end, and a lid 106 (e.g., a removable lid). In some embodiments, the security device 105 may have a rectangular or cylindrical shape. The lid 106 that can be opened and closed to load/unload the playing cards 110 from the security device 105. The playing cards can be inserted into the security device 105 and sealed at a secure playing card storage area. The playing cards 105 may remain in the security device 105 while the playing cards are transported from a secure playing card storage area to a card gaming table.

In some embodiments, the security device 105 may have a security seal (e.g., e.g., tamper proof seals, tape, locks, etc.) placed on the lid 106 after the playing cards have been sealed inside the security device. The security seal can be broken when the lid 106 is opened. If the seal is broken while the security device 105 is being transported from the secure storage site to the gaming table, the lid 105 may have been opened and the cards 110 may have been tampered with. Accordingly, the casino may discard or not use the playing cards in the security device 105 with a broken seal.

Figure 2:
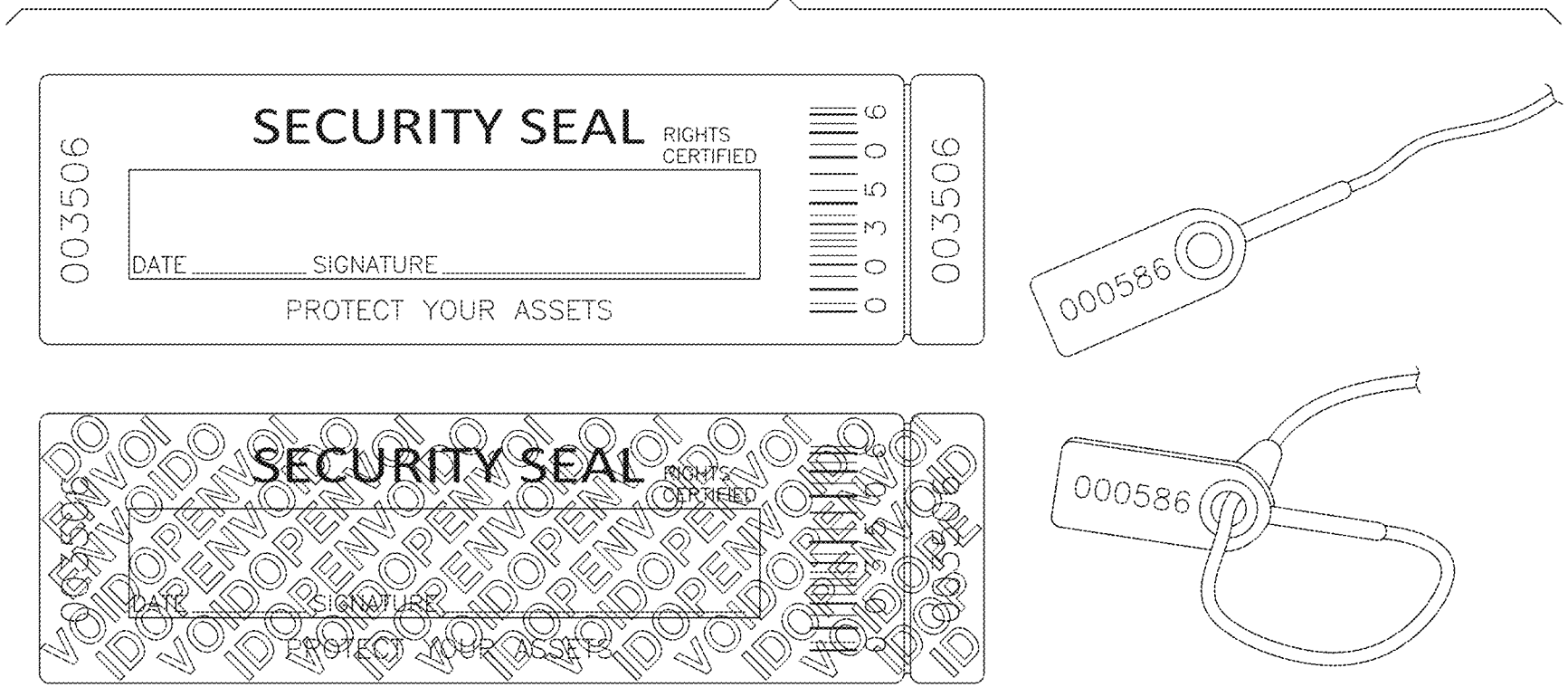
FIG. 2 shows an image of a security seal according to an embodiment of the present disclosure.

FIG. 2 shows an image of a security seal according to an embodiment of the present disclosure.

In FIG. 2, the security seal 210 may be used to determine if the security device 105 was tampered with during transport. In some embodiments, the security seal 210 may be placed on the lid 106 of the security device 105. Some examples of a security seal 210 may include tamper evident tape/sticker and pull-tight/"bolt" (e.g., zip tie) seals. In some embodiments, security seals 210 may have reference numbers written to identify the security seal 210 for movement/recordkeeping. Additionally, date and signature can be recorded on the security seals 210 directly. As will be appreciated, on the one hand, if a security seal 210 which is attached to the security device 105 remains intact, it can be assumed that no tampering has occurred with cards located within the security device 105. On the other hand, if the security seal 210 is no longer intact, it can be assumed that tampering may have occurred with the cards located within the security device.

Figure 3A:
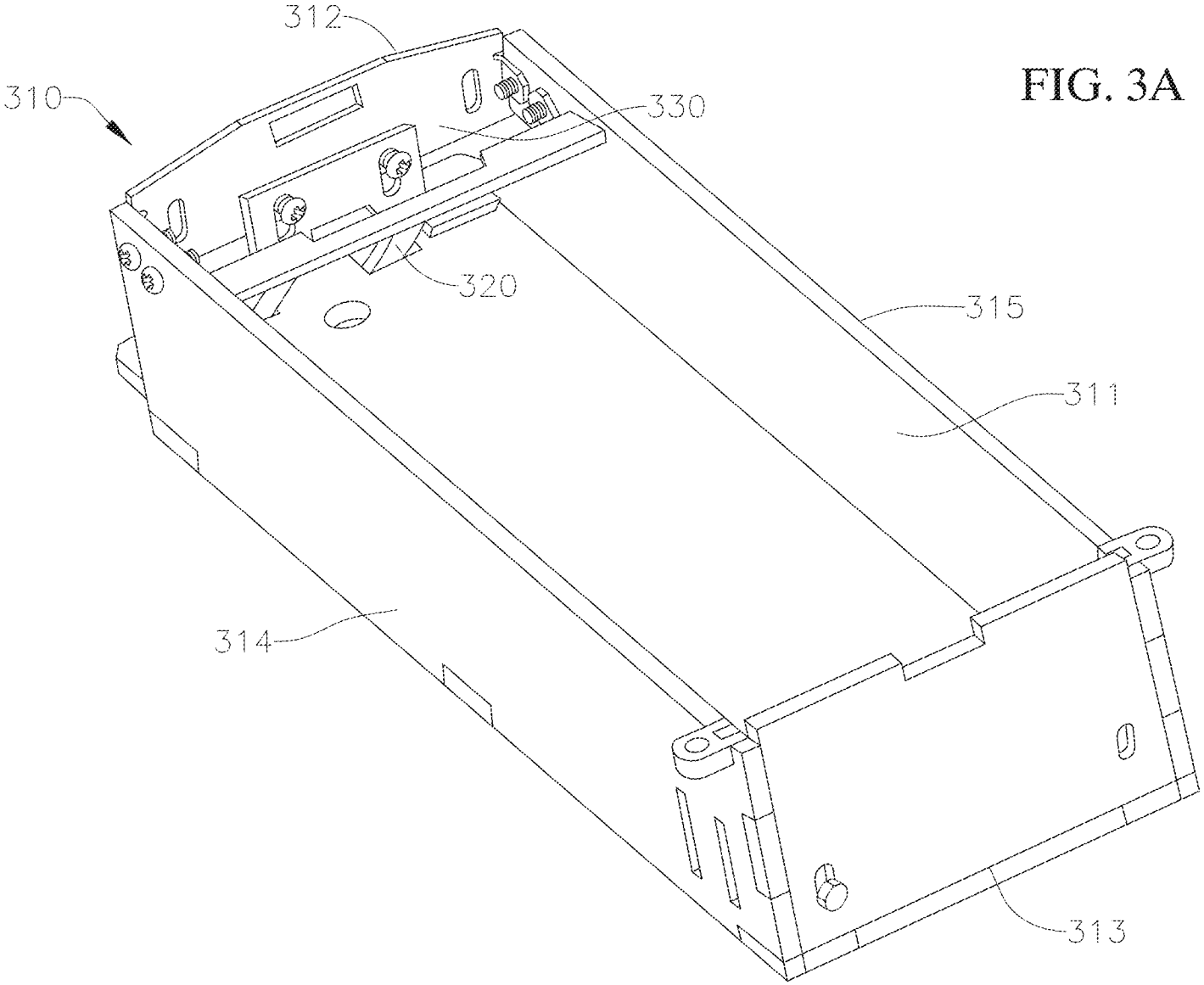
FIG. 3A shows a back perspective view of a card security device with an open lid according to an embodiment of the present disclosure.
Figure 3B:
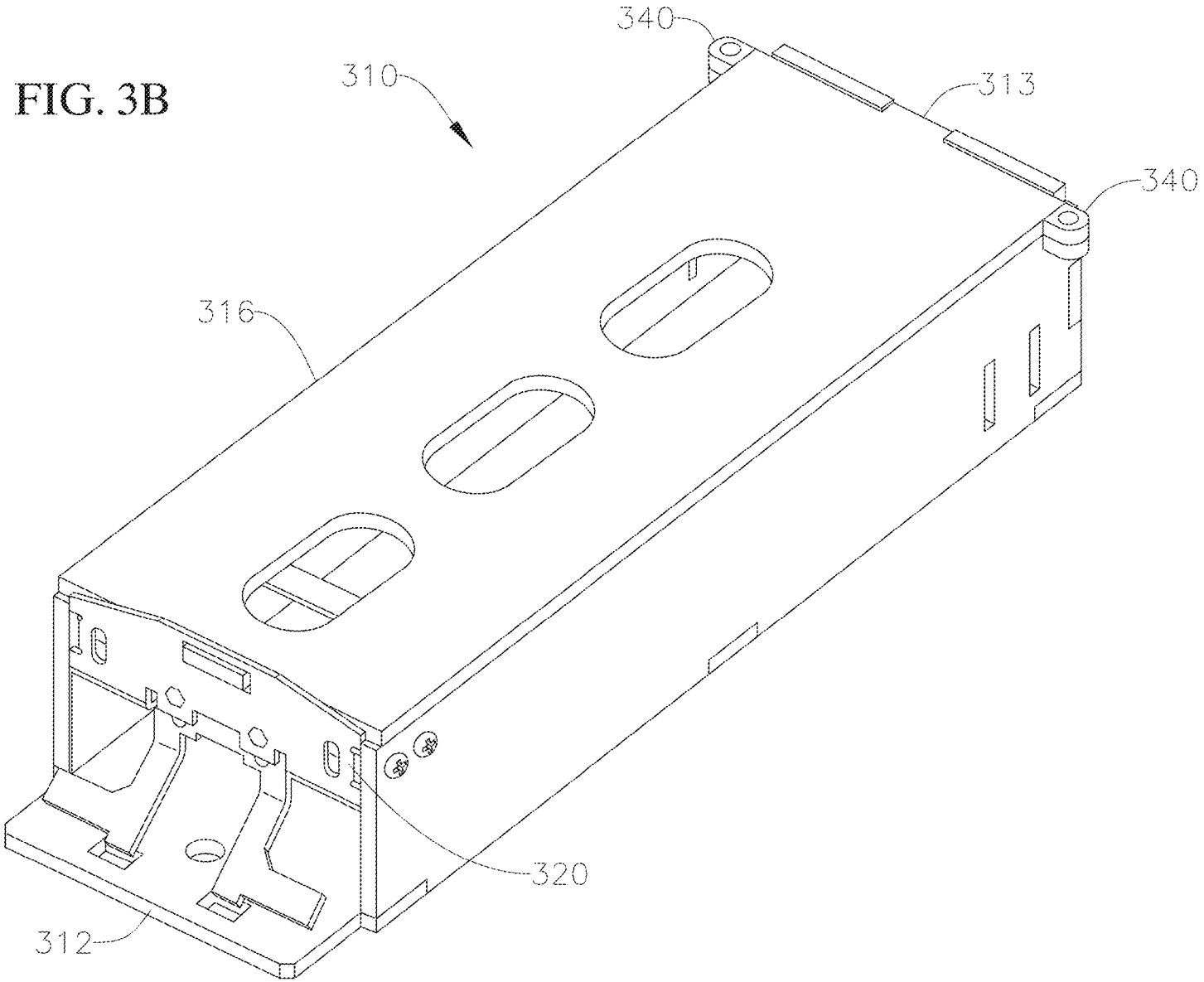
FIG. 3B shows a front perspective view of a card security device with a closed lid according to an embodiment of the present disclosure.

FIG. 3A shows a back perspective view of a card security device with an open lid accordingly to an embodiment of the present disclosure. FIG. 3B shows a front perspective view of a card security device with a closed lid according to an embodiment of the present disclosure.

As shown in FIG. 3A, the security device 310 may have an inner space 311 that may be used to house the playing cards during transport. The inner space 311 may be defined by a front end 312, a back end 313, lateral sides 314, 315, and a lid 316 (e.g., a removable lid). Further, the security device 310 may include a shoe connector 320 that is positioned at the front end 312. The shoe connector 320 may be configured to be attached to a corresponding connector on a card shoe (e.g., a card security device connector on the card shoe). A portion of the shoe connector 320 may be within the inner space 311 (e.g., inner portion of the shoe connector). In some embodiments, the inner portion of the shoe connector 320 may include one or more security seals 330. The security seals may be placed in an area above a latch (e.g., a movable latch). The latch is configured to move in a direction parallel to the front end 312 from a first position (e.g., a lower position or an unconnected position) to a second position (e.g., an elevated position or an connected position) when the security device 310 is connect to a card shoe. When the latch moves from the connected position to the unconnected position, it can contact the security seal 330 and break through the security seal 330 (e.g., cut or break the security seal) as the latch moves. For example, in some embodiments, the security seals 330 may be placed over one or more openings on the shoe connector 320. When the security device 310 is attached to the card shoe, a mechanism on the corresponding connector on the card shoe will apply a force (e.g. an upward force in a direction toward the lid 316) on a latch on the shoe connector 320 that will move the latch from the unconnected position to the connected position and through the opening on the shoe connector 320 and break the security seals 330. In other embodiments, the security seals 330 may be placed over an upper edge of the latch on the shoe connector 320. When the security device 310 is attached to a card shoe, a mechanism on the corresponding connector on the card shoe will apply a force on the latch (e.g. an upward force in a direction toward the lid 316) and will move the latch from the unconnected position to the connected position and break the security seal 330 over the upper edge of the latch.

FIG. 3B shows the security device 310 with a closed lid 316. The lid 316 may be closed after playing cards have been inserted into the inner space 311 of the security device 310 at the secure storage site. Further, the security device 310 may include a shoe connector 320 that is positioned at the front end 312. The shoe connector 320 may be configured to be attached to a corresponding connector on the card shoe. A portion of the shoe connector 320 may be outside the security device 310 (e.g., an outer portion of the shoe connector). In some embodiments, security seals may also be on the outer portion of the shoe connector 320. When the security device 310 is inserted into the shoe, the security seals on the outer portion of the shoe connector 320 may be broken.

In some embodiments, the back end 313 may include one or more bolt seal locations 340. The bolt seal locations 340 can allow for additional security seals of different types to be attached after the lid 316 has been closed.

Figure 4:
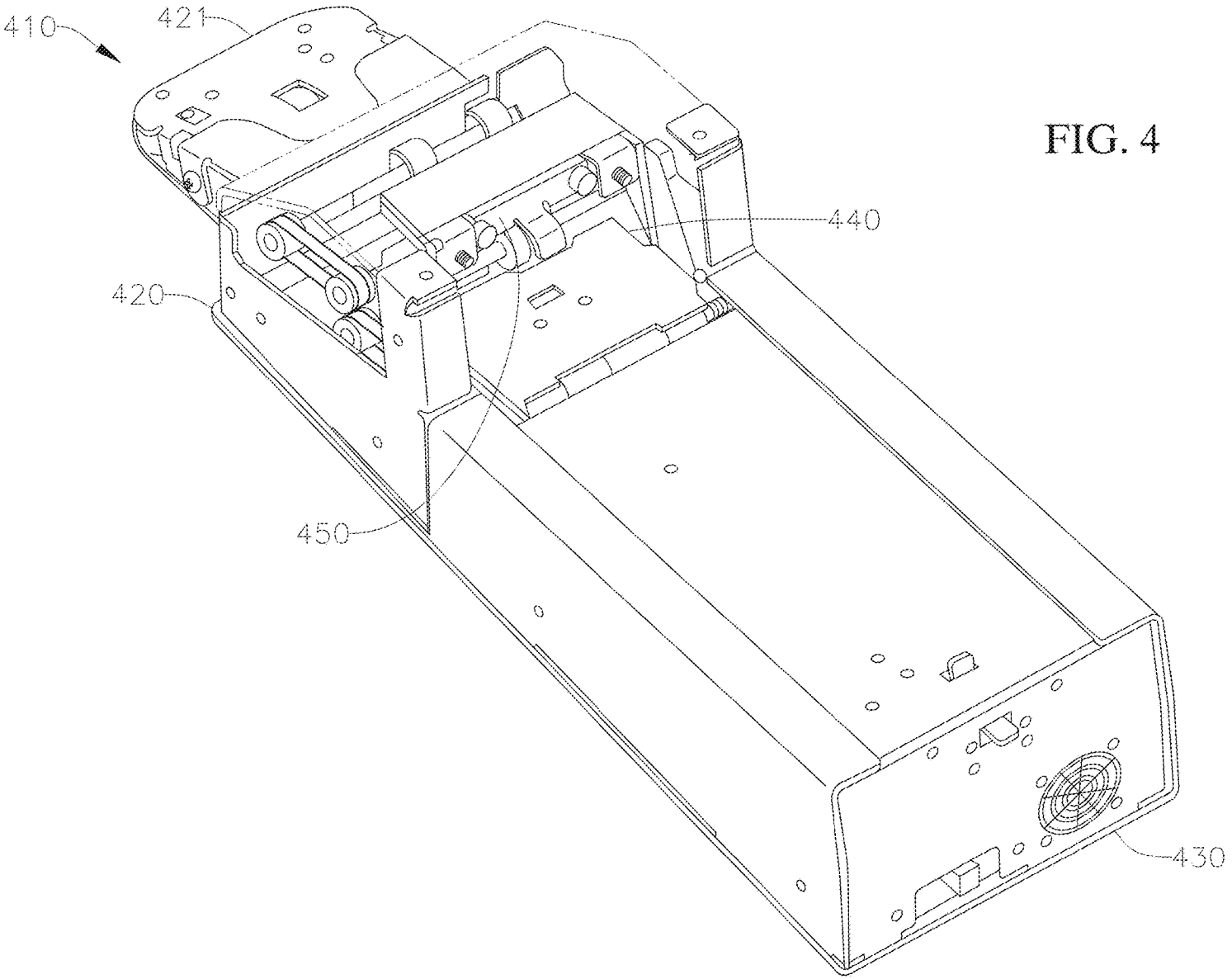
FIG. 4 shows an image of a card shoe according to an embodiment of the present disclosure.
Figure 5A:
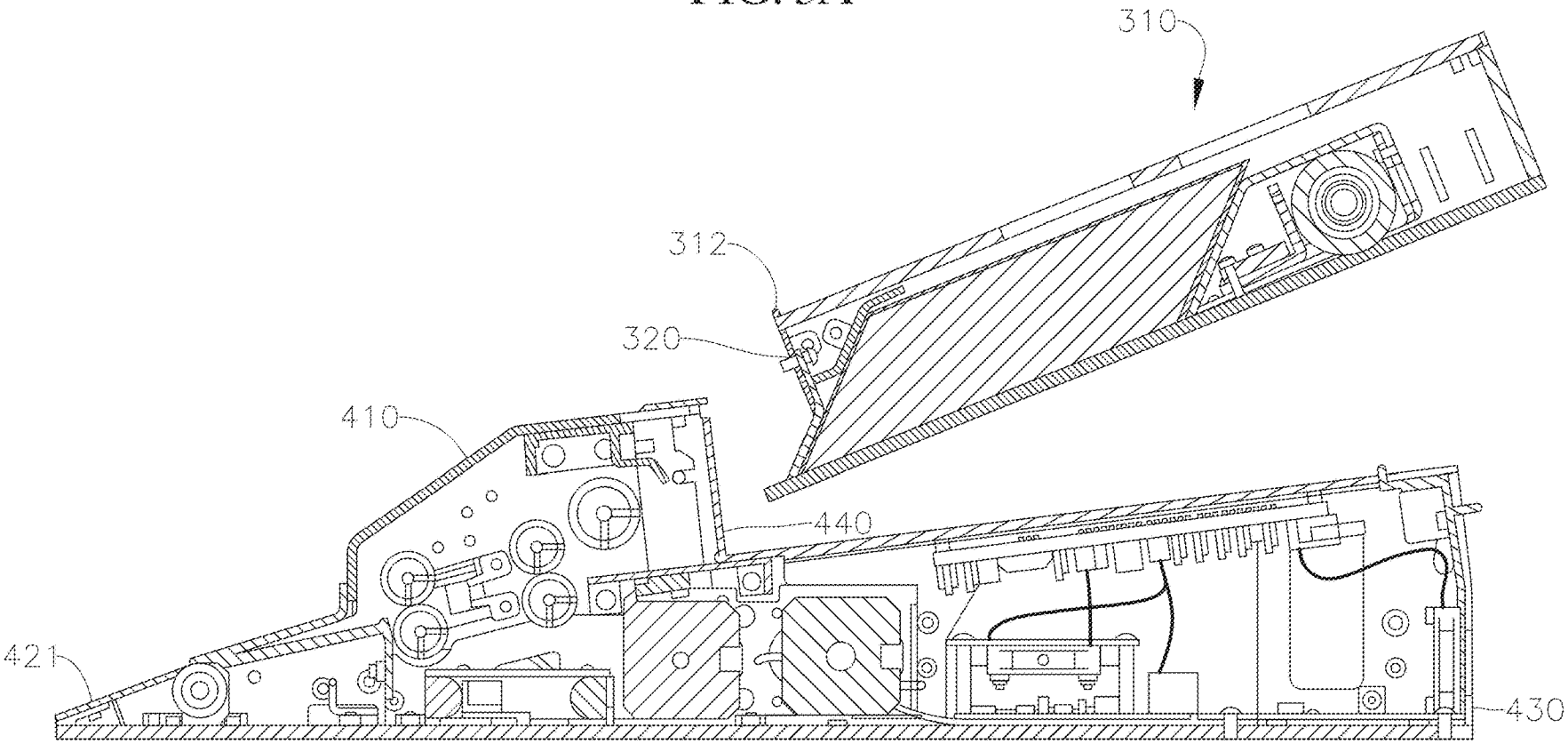
FIGS. 5A-5D show images of side views and back perspective views of a security device that is connected to a card shoe according to an embodiment of the present disclosure.
Figure 5B:
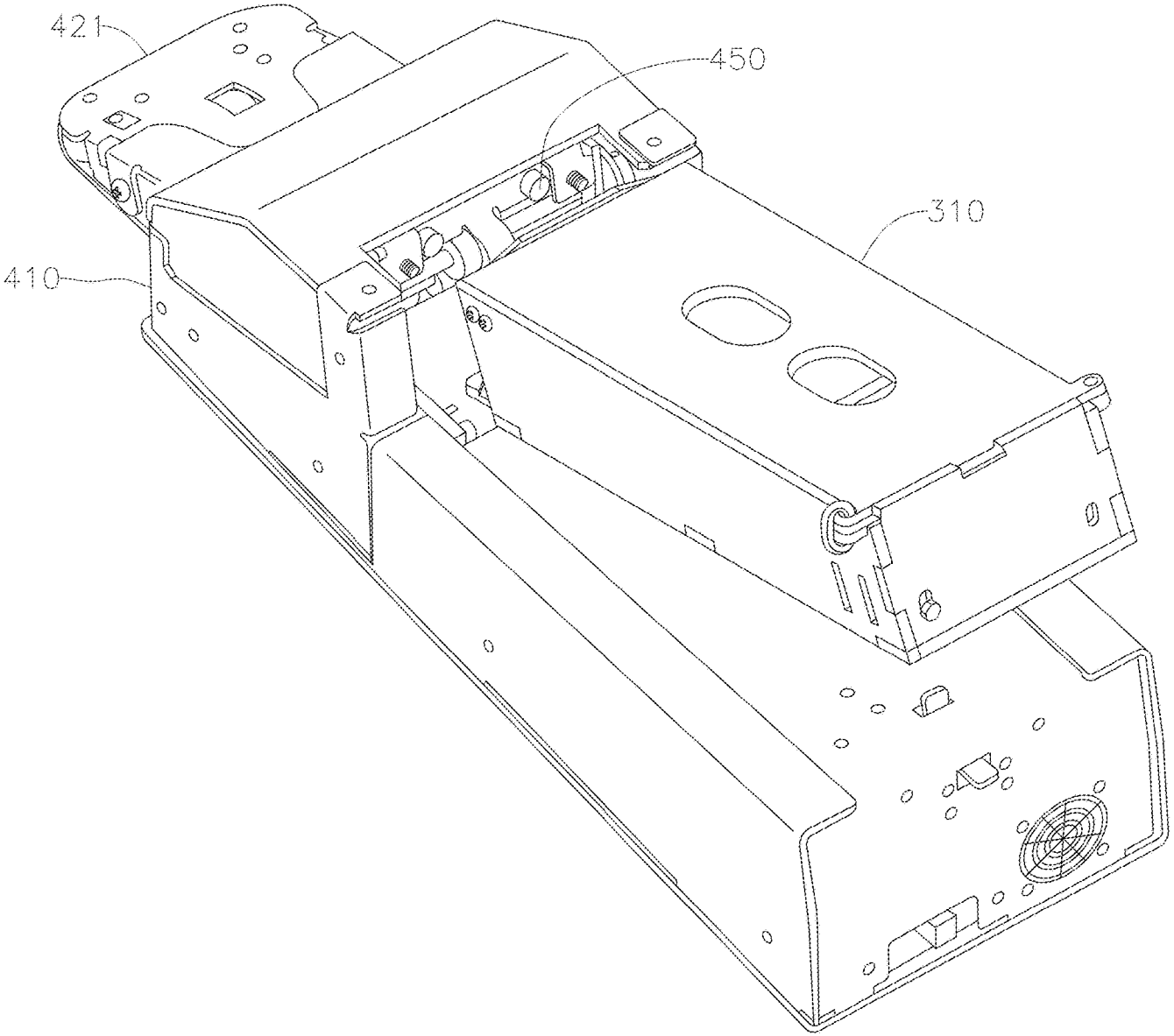
Figure 5C:
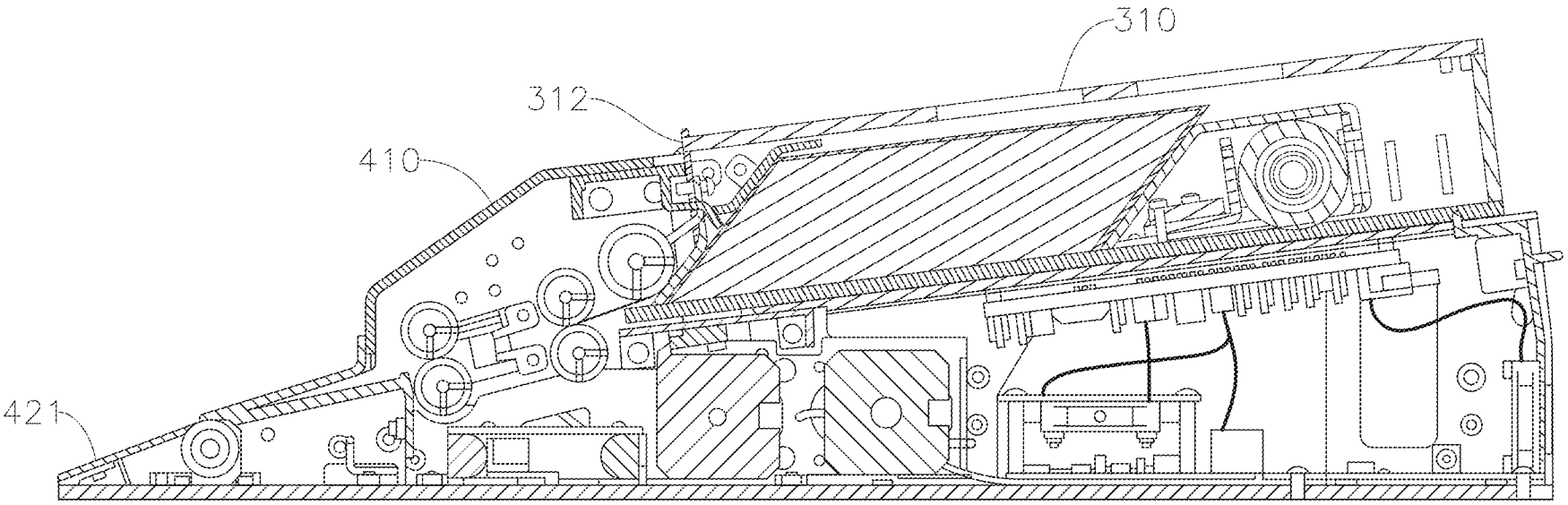
Figure 5D:
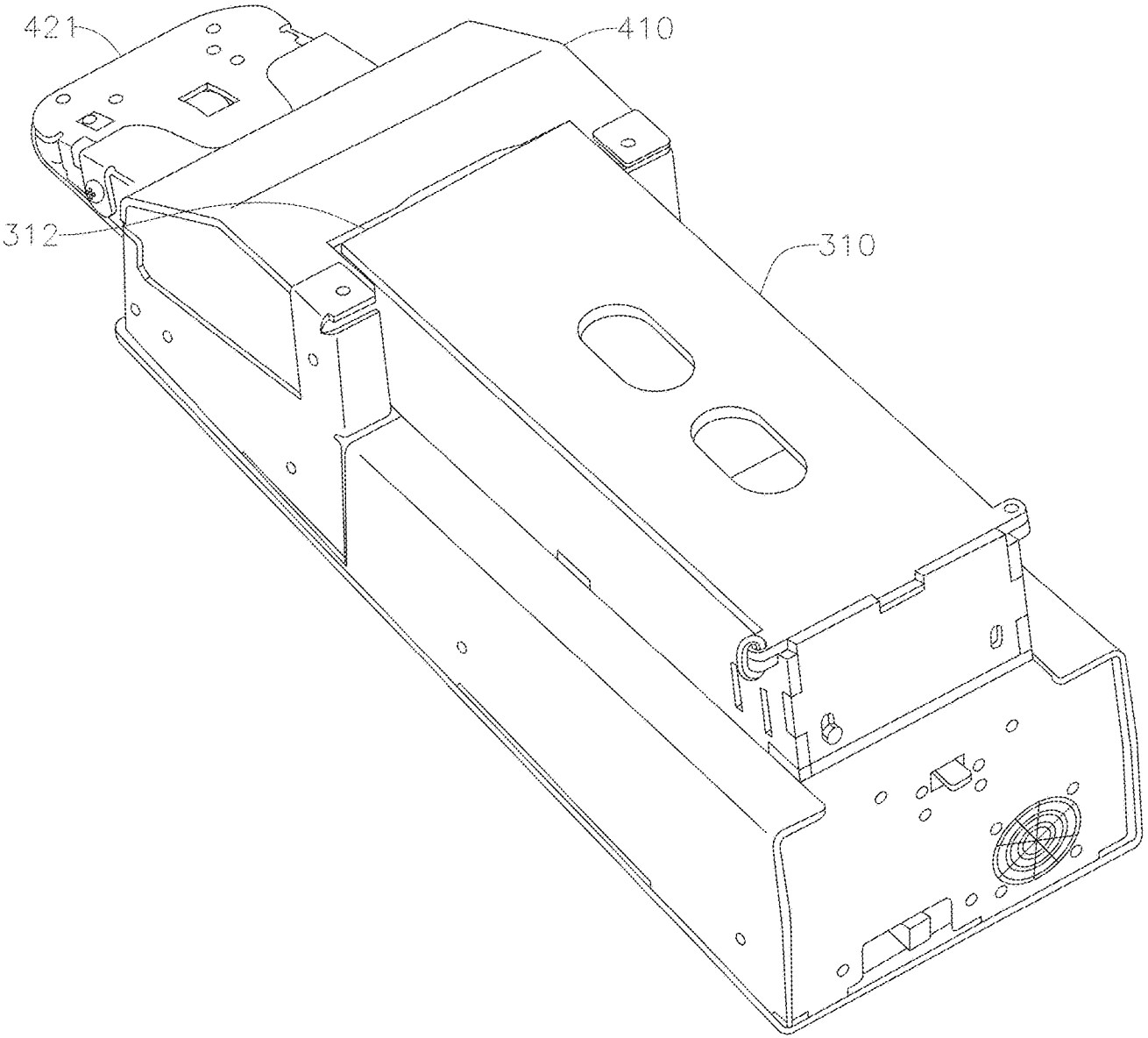

FIG. 4 shows an image of a card shoe according to an embodiment of the present disclosure.

As shown in FIG. 4, the card shoe 410 may include a front end 420 and a back end 430. The front end 420 includes a card dispenser 421 that is configured to dispense cards for the card game. Additionally, the card shoe 410 may include an opening 440 positioned between the front end 420 and the back end 430. The opening 440 may face toward the back end 430. Further, the opening 440 may also include a card security device connector 450 (e.g., a corresponding connector to the shoe connector 320). The card security connector 450 may be configured to connect to the shoe connector 320 of the card security device 310. The card security connector 450 may include a mechanism that, when the card security connector 450 is connected to the shoe connector 320, can apply a force on a latch (e.g. an upward force in a direction toward the lid 316) on the shoe connector 320 and move the latch in a direction parallel to the front end of the shoe connector 320 from a first position (e.g., a lower position or an unconnected position) to a second position (e.g., an elevated position or a connected position). In some embodiments, the latch may move through an opening on the shoe connector 320 where the security seals 330 are positioned. When the latch is pushed through the opening, it can break the security seals 330. In other embodiments, the security seals 330 may be placed over an upper edge of the latch. When the mechanism of the card security device connector 450 applies a force to the latch on the shoe connector 320, the latch can break the security seal 330 over the upper edge of the latch when the latch moves from the unconnected position to the connected position.

In some embodiments, the length of the card security device 310 may be substantially equal to the distance from the opening 440 and to the back end 430.

FIGS. 5A-5D show images of side views and back perspective views of a security device that is connected to a card shoe according to an embodiment of the present disclosure.

As shown in FIGS. 5A-5D, the card shoe 410 may be connected to the card security device 310 without removing the playing cards from the card security device 310. The front end 312 of the card security device 310 can be inserted into the opening 440 of the card shoe 410. The front end 312 of the card security device 310 may include a shoe connector 320 that is configured to be connected to the card security device connector 450 on the card shoe 410. When the shoe connector 320 connects to the card security device connector, a mechanism on the security device connector 450 will apply a force on a latch on the shoe connector 320 (e.g. an upward force in a direction toward the lid 316). The force can move the latch in a direction parallel to the front end 312 from a first position (e.g., a lower position or an unconnected position) to a second position (e.g., an elevated position or a connected position). The upper edge of the latch can break the security seals when the latch moves from the unconnected position to the connected position. This automatic seal tampering is used to ensure that the seal is not broken prior to the playing cards being used in a game. In some embodiments, the casino personnel (e.g., dealer) can decide if the card security device 310 is secured to the card shoe 410 with a push button/lever release or if it should be secured with a device that requires a key or a different type of authentication. Authentication may also include time release or event release from the server or badge/pin or biometric at the table/smart shoe.

In some embodiments, the length of the card security device 310 may be substantially equal to the distance from the opening 440 and to the back end 430.

Figure 6:
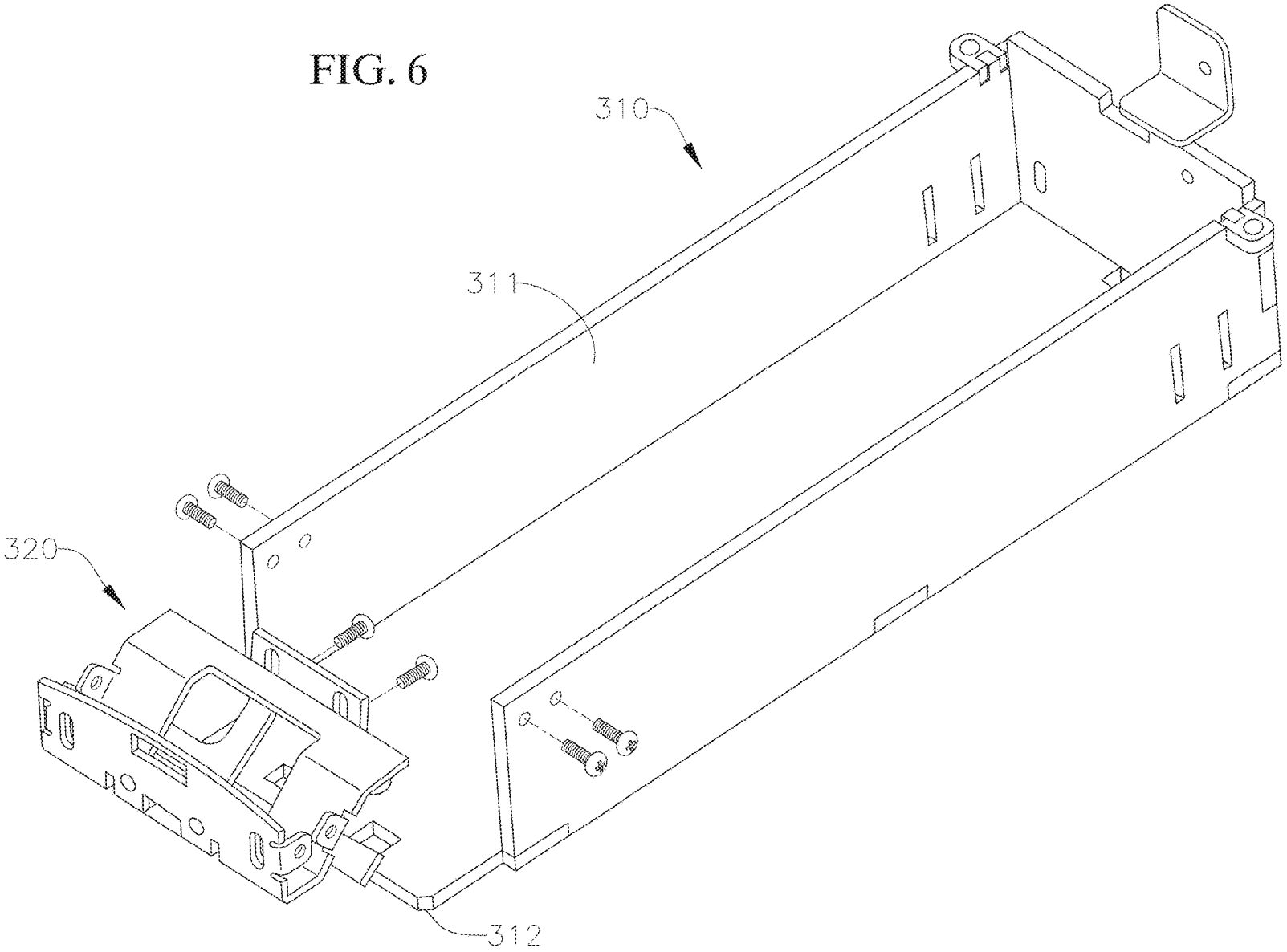
FIG. 6 shows an exploded view of a front perspective view of the card security device according to an embodiment of the present disclosure.

FIG. 6 shows an exploded view of a front perspective view of the card security device according to an embodiment of the present disclosure.

FIG. 6 shows a shoe connector 320 that may be placed at the front end 312 of the security device 310. The shoe connector 320 may be configured to be attached to a card security device connector on the card shoe. A portion of the shoe connector 320 may be within the inner space 311 (e.g., inner portion of the shoe connector). In some embodiments, the inner portion of the shoe connector 320 may include one or more security seals. The security seals may be placed in an area above a latch (e.g., a movable latch). The latch is configured to move in a direction parallel to the front end 312 from a first position (e.g., a lower position or an unconnected position) to a second position (e.g., a lower position or a connected position) when the security device 310 is connect to a card shoe. When the latch moves from the connected position to the unconnected position, it can contact the security seal 330 and break through the security seal 330 (e.g., cut or break the security seal) as the latch moves. For example, in some embodiments, the security seals 330 be placed over one or more openings on the shoe connector 320. When the security device 310 is attached to a card shoe, a mechanism on the card security connector of the card shoe will apply a force on a latch that will move the latch on the shoe connector 320 from the unconnected position to the connected position and through the opening on the shoe connector 320 and break the security seals. In other embodiments, the security seals may be placed over an upper edge of the latch on the shoe connector 320. When the security device 310 is attached to a card shoe, a mechanism on the card security connector of the card shoe will apply a force on the latch and move the latch on the shoe connector 320 from the unconnected position to the connected position and break the security seal 330 over the upper edge of the latch.

Figure 7A:
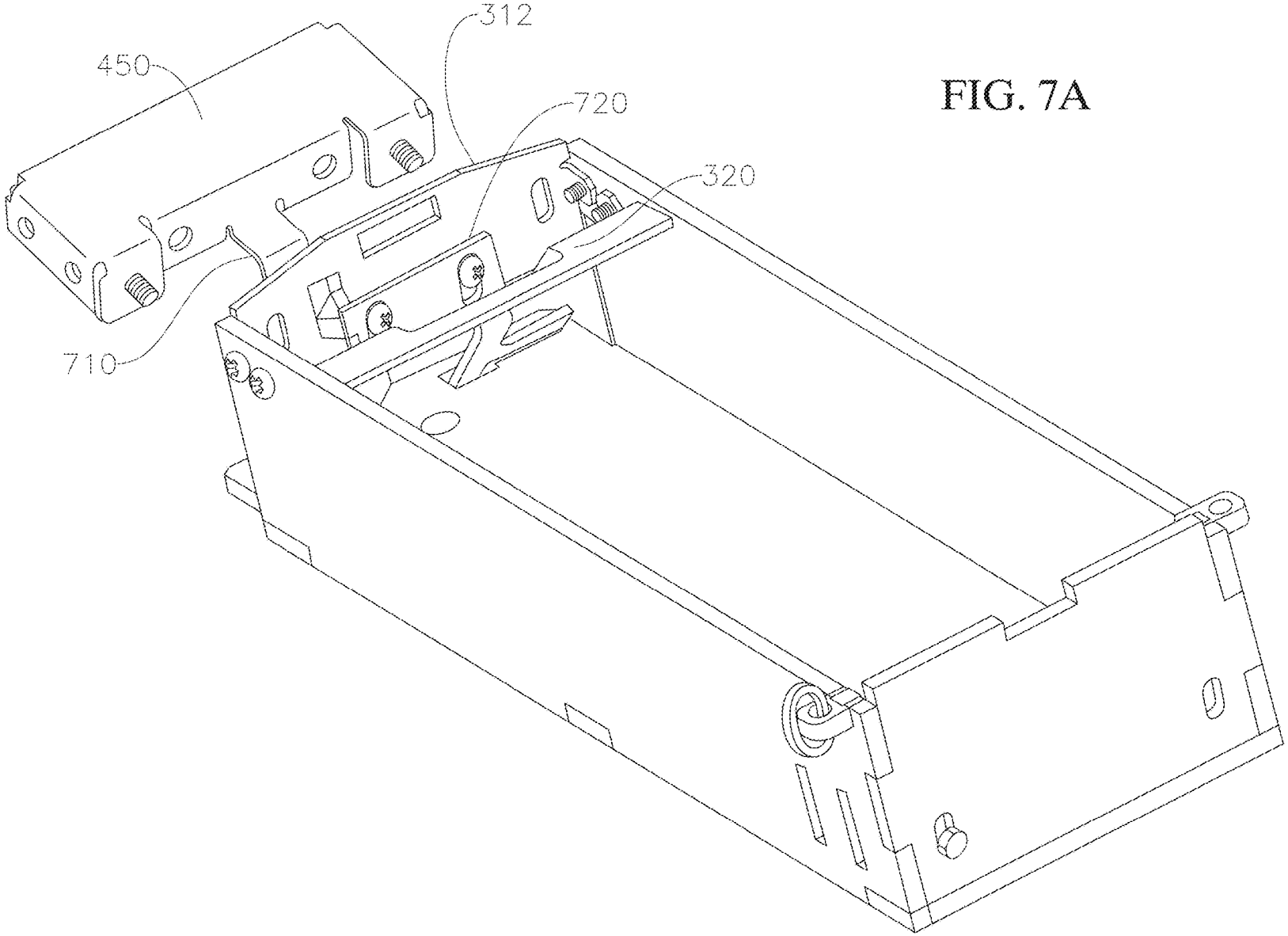
FIGS. 7A and 7B show images of the card shoe connector and the security device connector according to an embodiment of the present disclosure.
Figure 7B:
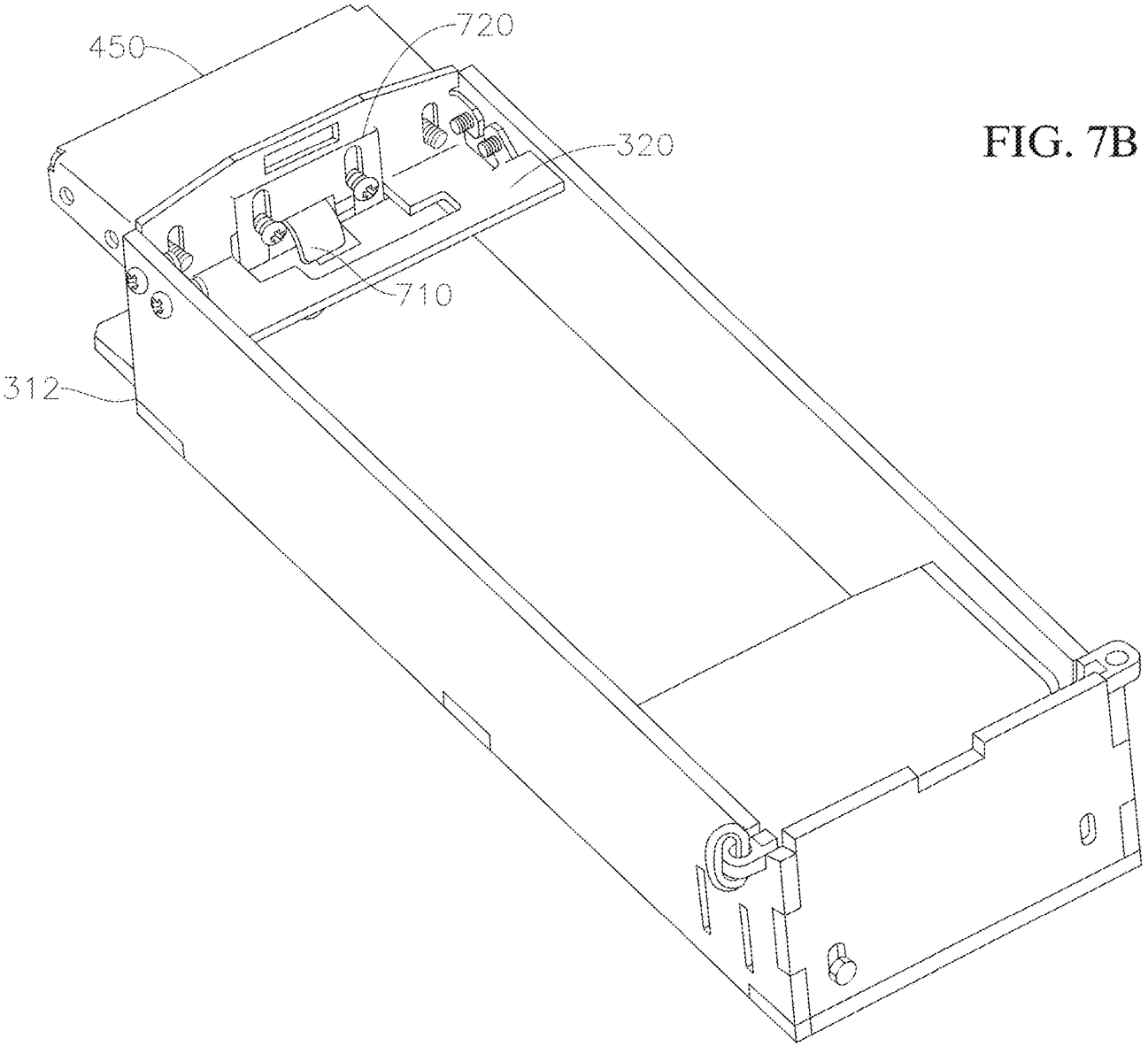

FIGS. 7A and 7B shoe images of the shoe connector and the security device connector according to an example embodiment of the present disclosure.

As shown in FIGS. 7A and 7B, the shoe connector 320 on the security device 310 may be configured to connect to the security device connector 450 on the card shoe. In some embodiments, the security device connector 450 may include a mechanism 710 that protrudes from the security device connector 450. In some embodiments, the shoe connector 320 may include a latch 720 that is configured to move in a direction parallel to the front end 312 from a first position (e.g., a lower position or an unconnected position) to a second position (e.g., an elevated position or a connected position) and from the second position back to the first position. For example, FIG. 7A shows the latch 720 in the unconnected position and FIG. 7B shows the latch 720 in the connected position. In some embodiments, a security seal may be placed in an area above the latch 720. When the latch moves from the connected position to the unconnected position, it can contact the security seal 330 and break through the security seal 330 (e.g., cut or break the security seal) as the latch moves. For example, in some embodiments, the security seals 330 may be placed over one or more openings on the shoe connector 320. When the card shoe connector 320 is connected to the card security device connector 450, the mechanism 710 will apply a force (e.g. an upward force in a direction toward the lid) on the latch 720 that will move the latch from the unconnected position to the connected position and break the security seals 330. In other embodiments, the security seals 330 may be placed over an upper edge of the latch 720. When the security device 310 is attached to a card shoe, the mechanism 710 will apply a force on the latch 720 and will move the latch 720 from the unconnected position to the connected position and break the security seal 330 over the upper edge of the latch 720. Accordingly, when the card security device connector 450 connects to the shoe connector 320, the security seal will automatically break without casino personnel physically touching the playing cards.

Figure 8A:
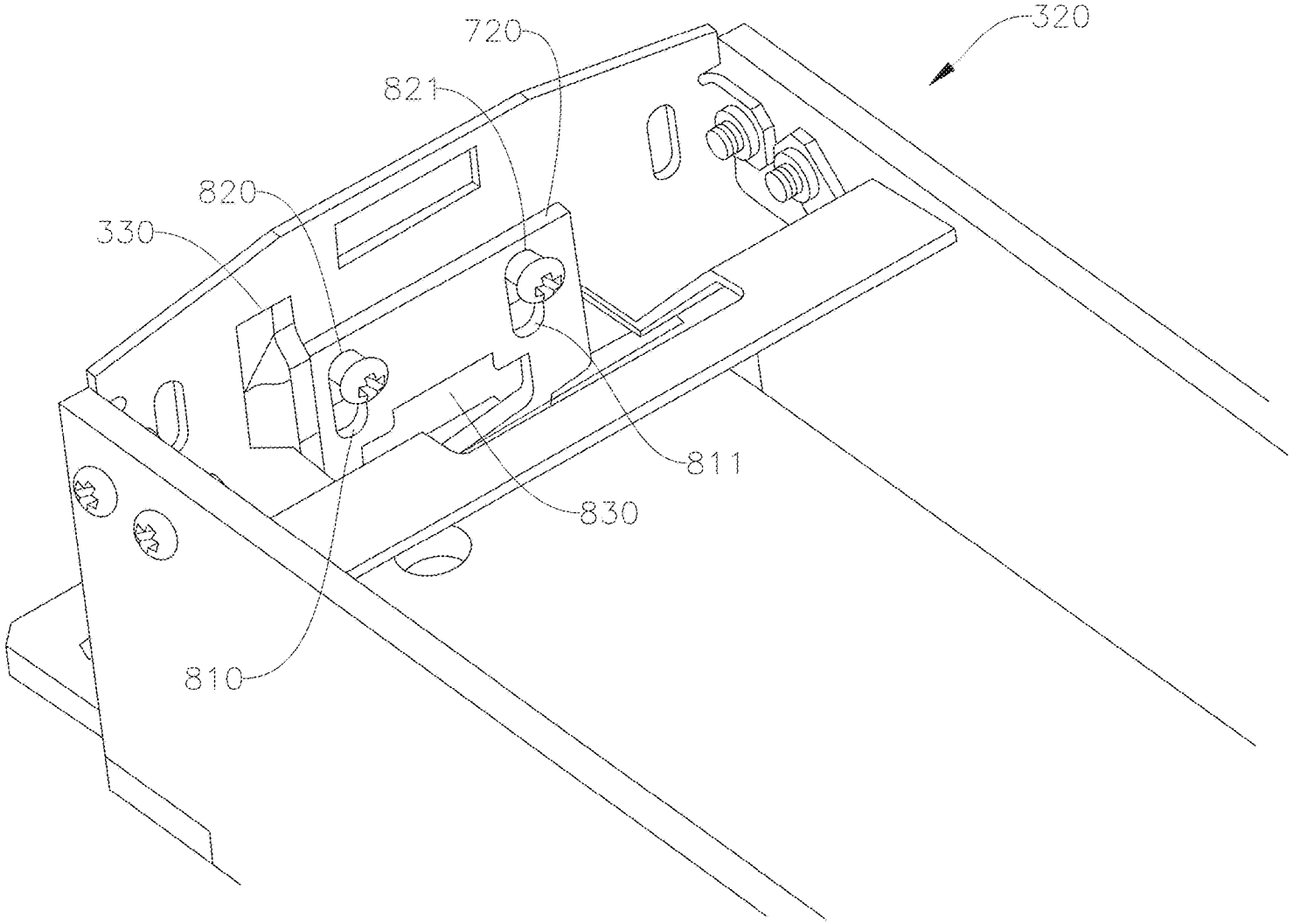
FIG. 8A shows the latch of the shoe connector in a lower position (e.g., an unconnected position) according to an embodiment of the present disclosure.
Figure 8B:
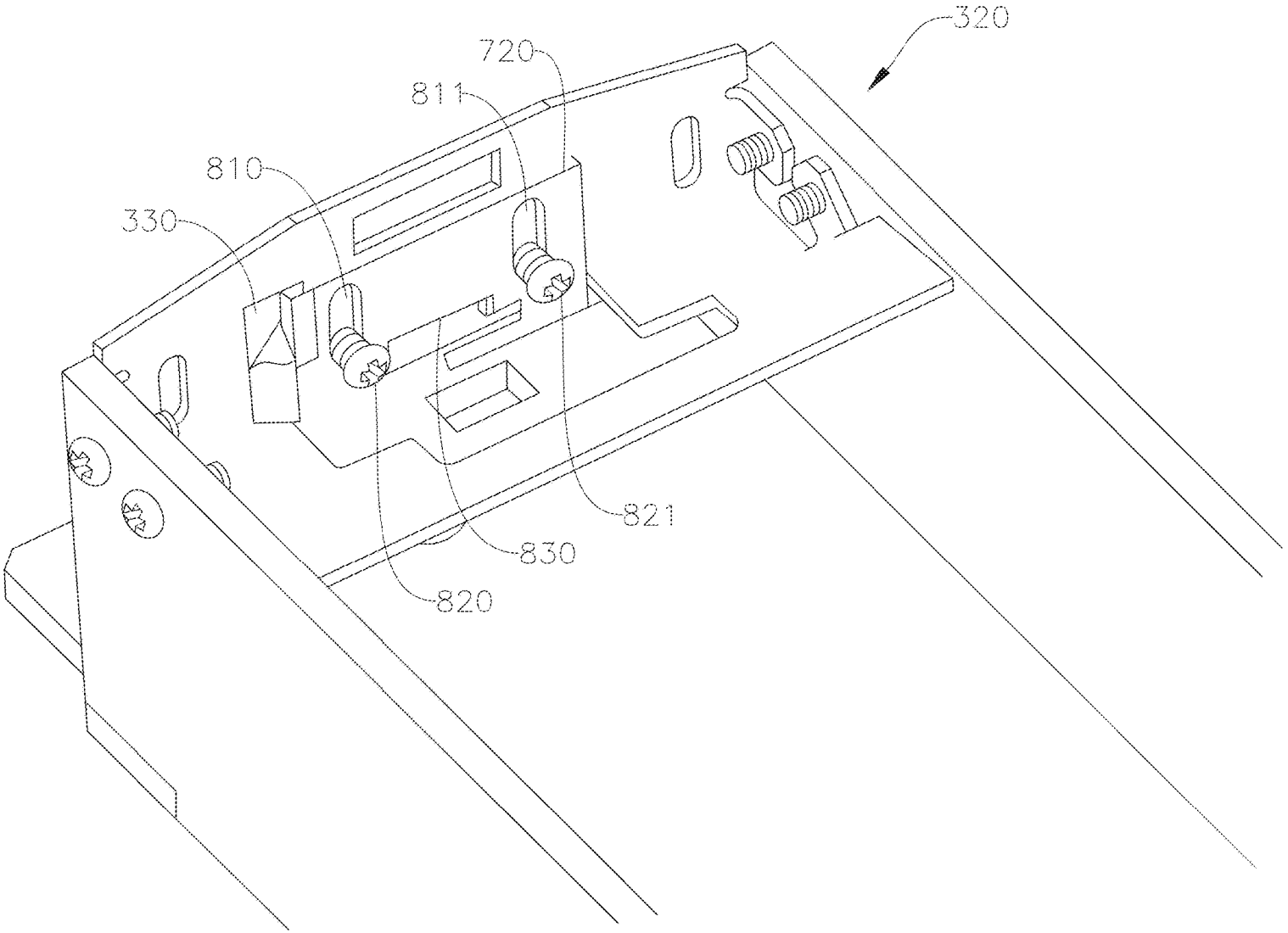
FIG. 8B show the latch of the shoe connector in an elevated position (e.g., a connected position) according to an embodiment of the present disclosure.

FIG. 8A shows the latch of the shoe connector in a lower position (e.g., an unconnected position) according to an embodiment of the present disclosure. FIG. 8B shows the latch of the shoe connector in an elevated position (e.g., a connected position) according to an embodiment of the present disclosure.

As shown in FIGS. 8A and 8B, the latch 720 may have guide openings 810 and 811. Two metal protrusions (e.g., screws) 820 and 821 from the shoe connector 320 may be inserted into the guide openings 810, 811. This configuration may allow the latch 720 to move in a direction parallel to the front end from the lower position (e.g., an unconnected position) to the elevated position (e.g., a connected position) and from the elevated position back to the lower position along the metal protrusions 820 and 821. In some embodiments, the latch 720 may also include a ridge 830 along a bottom edge of the latch 820. In some embodiments, the ridge 830 may have a shape that substantially aligns with a shape of the mechanism 710 of the card security device connector 450. The mechanism 710 may be configured to pass along the ridge 830 and apply a force on the latch 720 (e.g. an upward force in a direction toward the lid) causing the latch 720 to move from the unconnected position to the connected position.

In some embodiments, the shoe connector 320 may include a security seal 330 placed over an upper edge of the latch 720. When the latch 720 moves from the unconnected position to the connected position, the security seal 330 may be broken by the upper edge of the latch. In other embodiments, the security seal 330 may be positioned over an opening on the shoe connector 320. According to these embodiments, when the latch 720 moves from the unconnected position to the connected position, an upper edge of the latch 720 may pass through the opening and break the security seal 330.

Figure 8C:
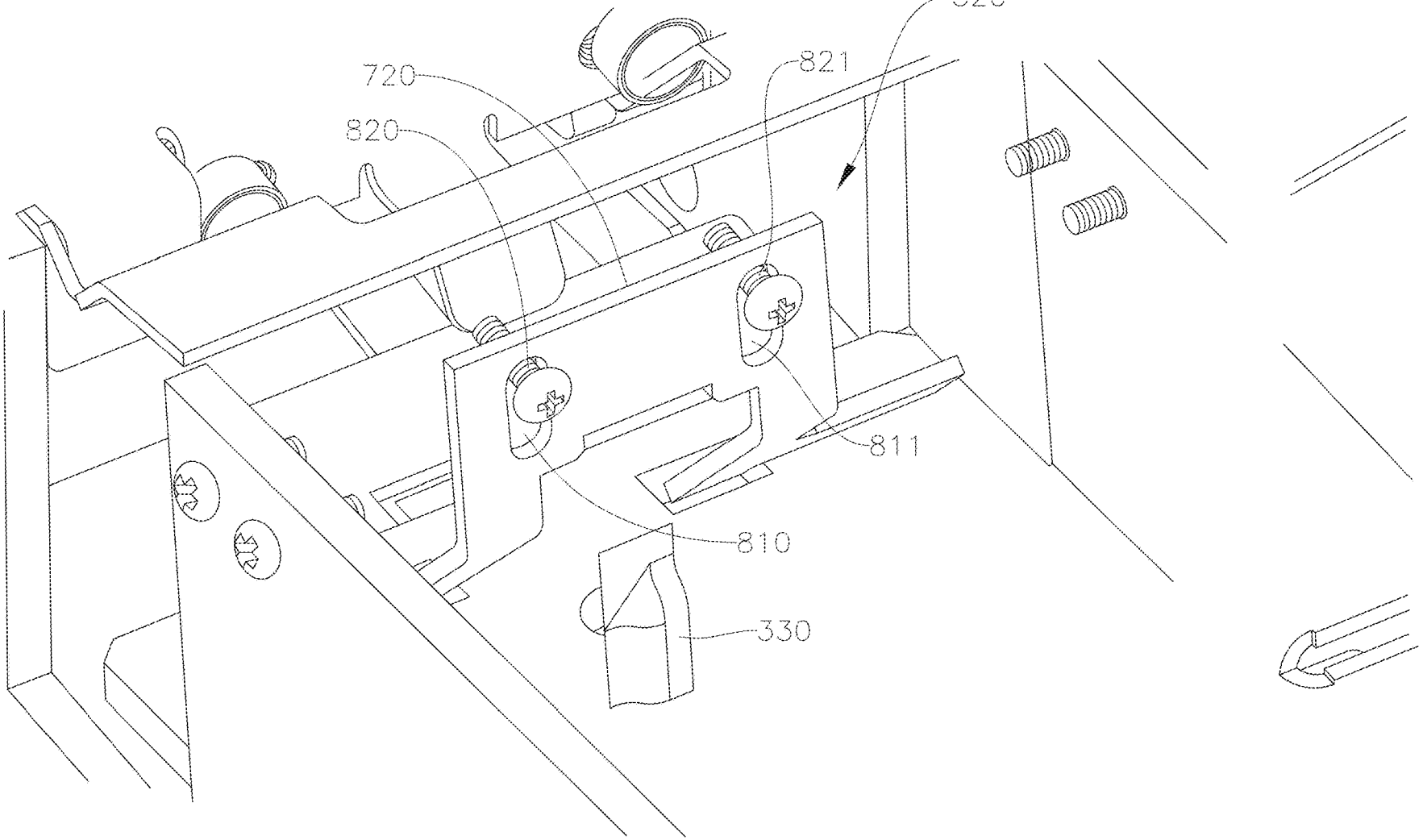
FIG. 8C shows an exploded view of the latch of the shoe connector in a lower position (e.g., an unconnected position) according to an embodiment of the present disclosure.
Figure 8D:
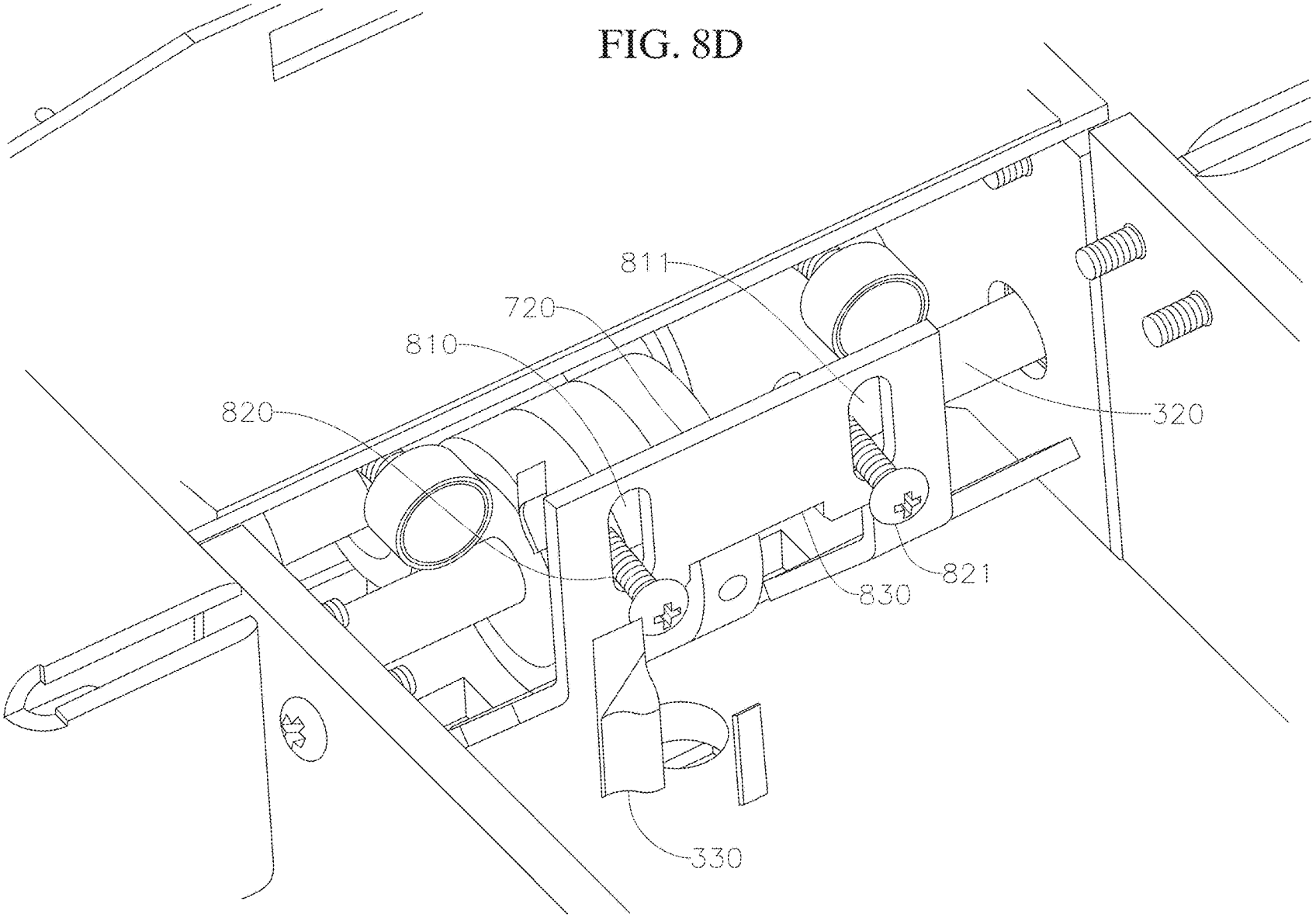
FIG. 8D shows an exploded view of the latch of the shoe connector in an elevated position (e.g., a connected position) according to an embodiment of the present disclosure.

FIG. 8C shows an exploded view of the latch of the shoe connector in a lower position (e.g., an unconnected position) according to an embodiment of the present disclosure. FIG. 8D shows an exploded view of the latch of the shoe connector in an elevated position (e.g., a connected position) according to an embodiment of the present disclosure.

As shown in FIGS. 8C and 8D, the latch 720 may have guide openings 810 and 811. Two metal protrusions (e.g., screws) 820 and 821 from the shoe connector 320 may be inserted into the guide openings 810, 811. This configuration may allow the latch 720 to move in a direction parallel to the front end from the lower position (e.g., an unconnected position) to the elevated position (e.g., a connected position) and from the elevated position to the lower position along the metal protrusions 820 and 821. In some embodiments, the latch 720 may also include a ridge 830 along a bottom edge of the latch 820. In some embodiments, the ridge 830 may have a shape that substantially aligns with a shape of the mechanism 710 of the card security device connector 450. The mechanism 710 may be configured to pass along the ridge 830 and apply a force on the latch 720 (e.g. an upward force in a direction toward the lid) causing the latch 720 to move from the unconnected position to the connected position.

In some embodiments, the shoe connector 320 may include a security seal 330 placed over an upper edge of the latch 720. When the latch 720 moves from the unconnected position to the connected position, the security seal 330 may be broken by the upper edge of the latch as shown in FIG. 8D. In some embodiments, the security seal 330 may be positioned over an opening on the shoe connector 320. According to these embodiments, when the latch 720 moves from the unconnected position to the connected position, an upper edge of the latch 720 may pass through the opening and break the security seal 330.

Figure 9A:
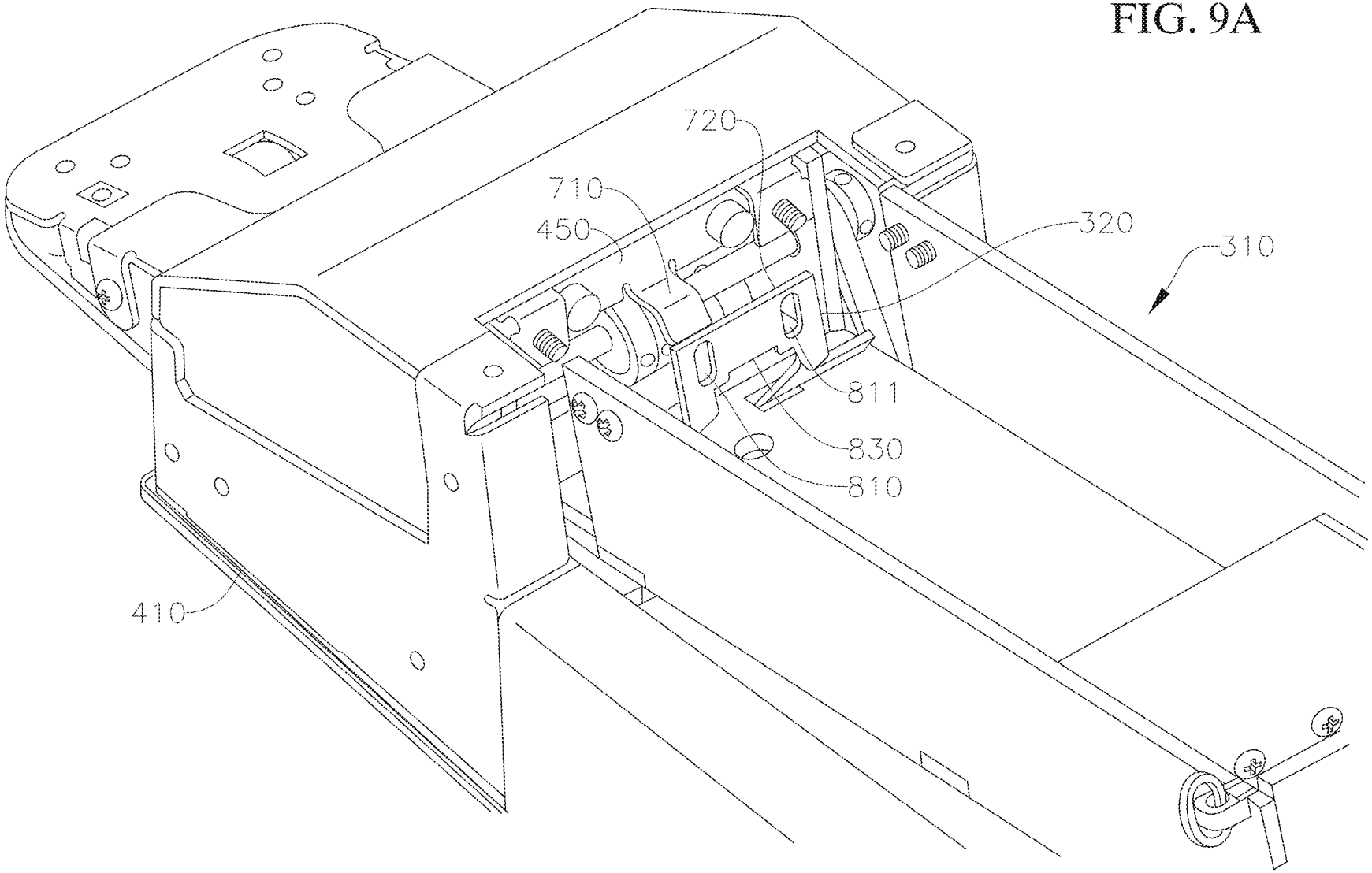
FIG. 9A shows the latch of the shoe connector in a lower position (e.g., an unconnected position) and the mechanism on the card shoe according to an embodiment of the present disclosure.
Figure 9B:
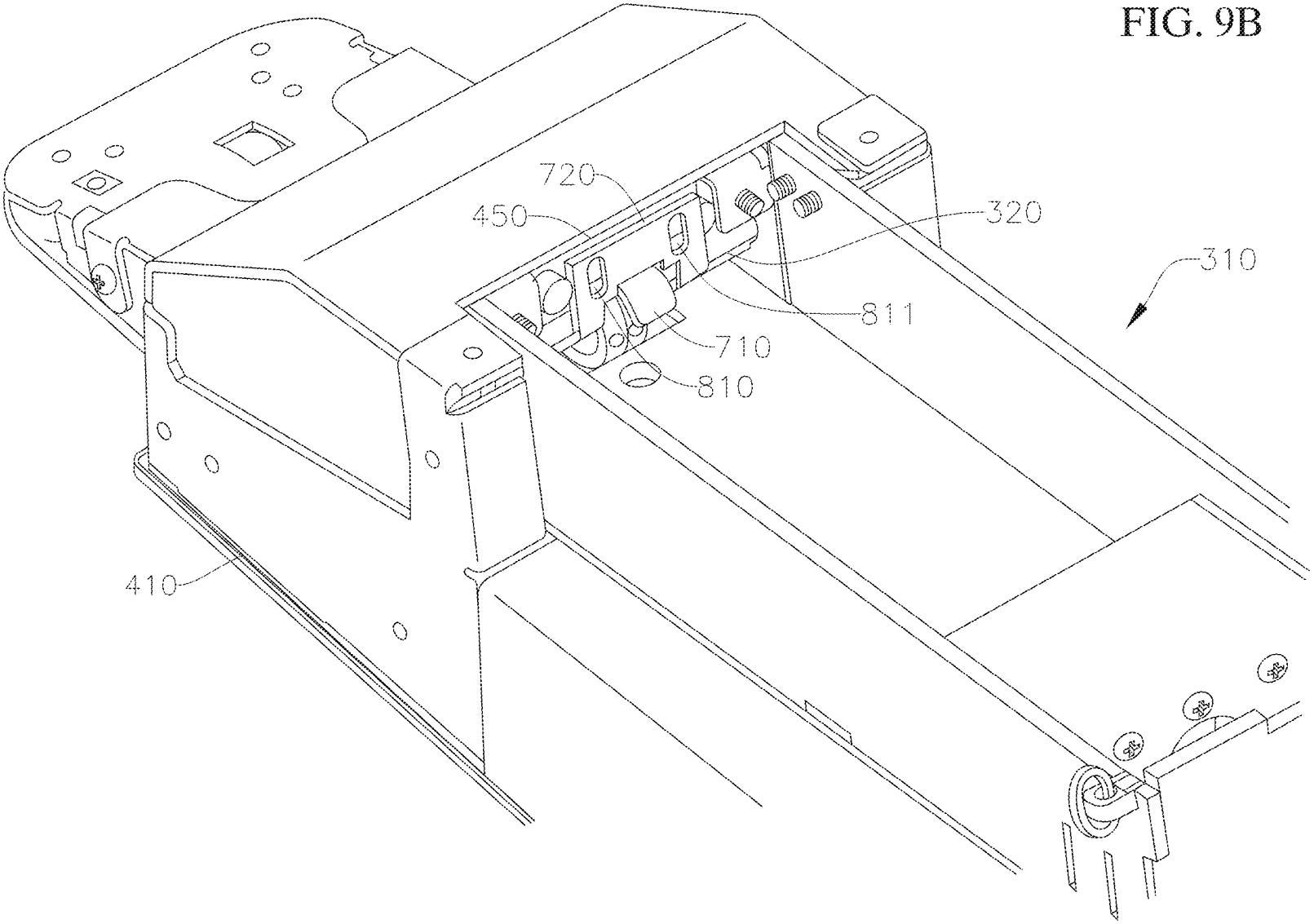
FIG. 9B show the latch of the shoe connector in an elevated position (e.g., a connected position) and the mechanism on the card shoe according to an embodiment of the present disclosure.

FIG. 9A shows the latch of the shoe connector in a lower position (e.g., an unconnected position) and the mechanism on the card shoe according to an embodiment of the present disclosure. FIG. 9B show the latch of the shoe connector in an elevated position (e.g., a connected position) and the mechanism on the card shoe according to an embodiment of the present disclosure.

As shown in FIGS. 9A and 9B, the mechanism 710 on the security device connector 450 can be configured to be guided through the ridge 830. In some embodiments, the shape of the ridge 830 may be substantially similar to the shape of the mechanism 710. When the mechanism 710 passes along the ridge 830, the mechanism 710 can apply a force on the latch 720 (e.g., an upward force in a direction toward the lid) causing the latch 720 to move up from the unconnected position to the connected position.

In some embodiments, the shoe connector 320 may include a security seal 330 placed over an upper edge of the latch 720. When the latch 720 moves from the unconnected position to the connected position, the security seal 330 may be broken by the upper edge of the latch. In some embodiments, the security seal 330 may be positioned over an opening on the shoe connector 320. According to these embodiments, when the latch 720 moves from the unconnected position to the connected position, an upper edge of the latch 720 may pass through the opening and break the security seal 330.

What is claimed is:

1. A card security device comprising:
- a front end;
- a back end;
- a lid;
- two lateral sides;
- an inner space defined by the front end, the back end, the two lateral sides, and the lid; and
- a card shoe connector at the front end, wherein the inner space is configured to accommodate playing cards,
- wherein the card shoe connector is configured to connect to a card shoe,
- wherein the card shoe connector comprises an outer portion outside of the inner space, an inner portion inside the inner space, and a security seal on the inner portion, and
- wherein the security seal is configured to break in response to the card shoe connector being connected to the card shoe.

2. The card security device of claim 1, wherein the card shoe connector further comprises a latch on the inner portion, the latch being configured to move in a direction parallel to a front end of the card security device from an unconnected position to a connected position.

3. The card security device of claim 2, wherein the security seal is attached above the latch on the inner portion such that it is adapted to break when the latch moves from the unconnected position to the connected position.

4. The card security device of claim 3, wherein the security seal is attached on an upper edge of the latch.

5. The card security device of claim 2, wherein the latch comprises a ridge at a bottom edge of the latch.

6. The card security device of claim 5, wherein the ridge has a shape that substantially aligns with a shape of a mechanism on a card security device connector such that the mechanism is permitted to move along the ridge and apply an upward force on the latch.

7. The card security device of claim 2, wherein the latch comprises guide openings that are configured to move along metal protrusions when the latch moves from the connected position to the unconnected position.

8. The card security device of claim 1, wherein the security seal comprises at least one of a tamper evident tape or a pull-tight seal.

9. A card security device comprising:
- an inner space configured to accommodate playing cards; and
- a card shoe connector comprising:
  - an outer portion outside of the inner space;
  - an inner portion inside the inner space;
  - a latch on the inner portion, the latch configured to move in a direction parallel to a front end of the card security device from an unconnected position to a connected position; and
  - a security seal on the inner portion,
- wherein the latch is configured to move from the unconnected position to the connected position and break the security seal in response to the card shoe connector being connected to a card shoe.

10. The card security device of claim 9, wherein the security seal is attached above the latch on the inner portion such that it is adapted to break when the latch moves from the unconnected position to the connected position.

11. The card security device of claim 10, wherein the security seal is attached on an upper edge of the latch.

12. The card security device of claim 10, wherein the latch comprises a ridge at a bottom edge of the latch.

13. The card security device of claim 12, wherein the ridge has a shape that substantially aligns with a shape of a mechanism on a card security device connector such that the mechanism is permitted to move along the ridge and apply an upward force on the latch.

14. The card security device of claim 9, wherein the latch comprises guide openings that are configured to move along metal protrusions when the latch moves from the connected position to the unconnected position.

15. The card security device of claim 9, wherein the security seal comprises at least one of a tamper evident tape or a pull-tight seal.

16. A method for breaking a security seal on a card security device, the method comprising:
- inserting, by a user, a card shoe connector on the card security device into a card security device connector on a card shoe, wherein playing cards are accommodated in an inner space of the card security device, wherein the card shoe connector comprises an outer portion outside the inner space, an inner portion inside the inner space, and a latch on the inner portion, and wherein the security seal is on the inner portion; and
- breaking the security seal via the latch on the card shoe connector, the latch moving in a direction parallel to a front end of the card security device from an unconnected position to a connected position in response to the card shoe connector being connected to the card shoe.

17. The method of claim 16, wherein the security seal is attached above the latch on the inner portion such that it is adapted to break when the latch moves from the unconnected position to the connected position.

18. The method of claim 17, wherein the security seal is attached on an upper edge of the latch.

19. The method of claim 16, wherein the security seal comprises at least one of a tamper evident tape or a pull-tight seal.

20. The card security device of claim 1, wherein the security seal comprises a tamper evident tape.

* * * * *